US010108114B2

(12) United States Patent
Mori

(10) Patent No.: US 10,108,114 B2
(45) Date of Patent: Oct. 23, 2018

(54) IMAGE FORMING SYSTEM, IMAGE FORMING APPARATUS, AND TRANSFER CONDITION CHANGING METHOD

(71) Applicant: Konica Minolta, Inc., Chiyoda-ku, Tokyo (JP)

(72) Inventor: Tomohide Mori, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/234,317

(22) Filed: Aug. 11, 2016

(65) Prior Publication Data

US 2017/0060042 A1 Mar. 2, 2017

(30) Foreign Application Priority Data

Aug. 24, 2015 (JP) ..... 2015-164553

(51) Int. Cl.
*G03G 15/16* (2006.01)
*G03G 15/00* (2006.01)

(52) U.S. Cl.
CPC ..... *G03G 15/1615* (2013.01); *G03G 15/652* (2013.01); *G03G 15/1675* (2013.01)

(58) Field of Classification Search
CPC ..... G03G 15/1615; G03G 15/652; G03G 15/1675
See application file for complete search history.

(56) References Cited

U.S. PATENT DOCUMENTS 5,631,725 A * 5/1997 Harasawa ..... G03G 15/1675 399/312
8,965,245 B2 * 2/2015 Atwood ..... G03G 15/168 399/121
2007/0023561 A1 * 2/2007 Kemppainen ..... B65H 18/22 242/532.3
2009/0190982 A1 * 7/2009 Yamamoto ..... B65H 29/12 399/406
2013/0287460 A1 * 10/2013 Kitagawa ..... G03G 15/2075 399/333

FOREIGN PATENT DOCUMENTS

JP 59223643 A 12/1984
JP S59223643 A 12/1984
JP 08146831 A 6/1996
(Continued)

OTHER PUBLICATIONS

Notice of Reasons for Rejection for corresponding JP Application No. 2015-164553; dated Jul. 31, 2017.
(Continued)

*Primary Examiner* — Gregory H Curran
(74) *Attorney, Agent, or Firm* — Cantor Colburn LLP

(57) ABSTRACT

An image forming system includes: a transfer unit configured to transfer a toner image onto a recording medium conveyed from a state in which the recording medium is wound into a roll; an external diameter information sensing unit configured to sense information about an external diameter of the recording medium wound into the roll; and a control unit configured to change a transfer condition in the transfer unit in accordance with the external diameter information sensed by the external diameter information sensing unit.

15 Claims, 9 Drawing Sheets

(56) References Cited

FOREIGN PATENT DOCUMENTS

| | | | |
|---|---|---|---|
| JP | H08146831 | A | 6/1996 |
| JP | 2002091237 | A | 3/2002 |
| JP | 2007271798 | A | 10/2007 |
| JP | 2011042137 | A | 3/2011 |
| JP | 2015004847 | A | 1/2015 |
| JP | 2015055672 | A | 3/2015 |

OTHER PUBLICATIONS

JP Notice of Reasons for Rejection corresponding to Application No. 2015-164553; dated Dec. 28, 2017.

* cited by examiner

IMAGE FORMING SYSTEM, IMAGE FORMING APPARATUS, AND TRANSFER CONDITION CHANGING METHOD

The entire disclosure of Japanese Patent Application No. 2015-164553 filed on Aug. 24, 2015 including description, claims, drawings, and abstract are incorporated herein by reference in its entirety.

BACKGROUND OF THE INVENTION

Field of the Invention

The present invention relates to an image forming system, an image forming apparatus, and a transfer condition changing method.

Description of the Related Art

An image forming apparatus (such as a printer, a copying machine, or a facsimile machine) using an electrophotographic process technology normally forms an electrostatic latent image by illuminating (exposing) an electrically charged photoreceptor with laser light based on image data. As toner is supplied from a developing device to the photosensitive drum having the electrostatic latent image formed thereon, the electrostatic latent image is made visible, and a toner image is formed. This toner image is further transferred directly or indirectly onto a paper sheet. After that, the toner image is fixed with heat and pressure at a fixing nip. Thus, a toner image is formed on the paper sheet.

Image forming systems have also been put into practical use. In an image forming system, a sheet feeding device that supplies a continuous paper sheet (hereinafter referred to as a "long paper sheet") such as continuous roll paper or folded paper to the front unit and the back unit of the image forming apparatus is connected to a sheet discharging device that stores the long paper sheet on which toner images have been formed by the image forming apparatus.

JP 2007-271798 A discloses a technique for preventing scattering and noise by reducing the transfer bias when the bottom end region of the back surface curled in an upwardly protruding manner passes through the transfer nip, in accordance with sheet information indicating whether printing is being performed on the back surface in two-side printing, the type of the printing sheet, and the like.

In a case where a long paper sheet wound into a roll is stored in the sheet feeding device, the entire long paper sheet is curled. Furthermore, since the curvature radius varies with positions in the radial direction of the roll, the degree of curling of the long paper sheet changes by the second as the printing operation progresses. When a toner image is transferred from the intermediate transfer belt onto the curled long paper sheet, for example, a space is formed between the intermediate transfer belt and the long paper sheet in the region immediately before the transfer nip. Due to this space, electrical discharge occurs in the region immediately before the transfer nip. Due to the electrical discharge that has occurred between the long paper sheet and the toner image on the intermediate transfer belt, the polarity of the charge of the toner particles forming the toner image on the intermediate transfer belt is reversed. As a result, even if a transfer voltage is applied at the transfer nip, the toner image is not transferred to part of the long paper sheet, resulting in poor image quality (missing in the transfer).

The technique disclosed in JP 2007-271798 A does not take into consideration the fact that the degree of curling of the long paper sheet changes because the long paper sheet is wound into a roll. Therefore, the technique disclosed in JP 2007-271798 A is unable to solve the above problem.

SUMMARY OF THE INVENTION

An object of the present invention is to provide an image forming system, an image forming apparatus, and a transfer condition changing method that can prevent a defective transfer to be caused by curling of a long paper sheet that is wound into a roll.

To achieve the abovementioned object, according to an aspect, an image forming system reflecting one aspect of the present invention comprises: a transfer unit configured to transfer a toner image onto a recording medium conveyed from a state in which the recording medium is wound into a roll; an external diameter information sensing unit configured to sense information about an external diameter of the recording medium wound into the roll; and a control unit configured to change a transfer condition in the transfer unit in accordance with the external diameter information sensed by the external diameter information sensing unit.

To achieve the abovementioned object, according to an aspect, an image forming apparatus reflecting one aspect of the present invention comprises: a transfer unit configured to transfer a toner image onto a recording medium conveyed from a state in which the recording medium is wound into a roll; an external diameter information sensing unit configured to sense information about an external diameter of the recording medium wound into the roll; and a control unit configured to change a transfer condition in the transfer unit in accordance with the external diameter information sensed by the external diameter information sensing unit.

To achieve the abovementioned object, according to an aspect, a method of changing a transfer condition for transferring a toner image onto a recording medium conveyed from a state in which the recording medium is wound into a roll reflecting one aspect of the present invention comprises: sensing information about an external diameter of the recording medium wound into the roll; and changing the transfer condition in accordance with the sensed external diameter information.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
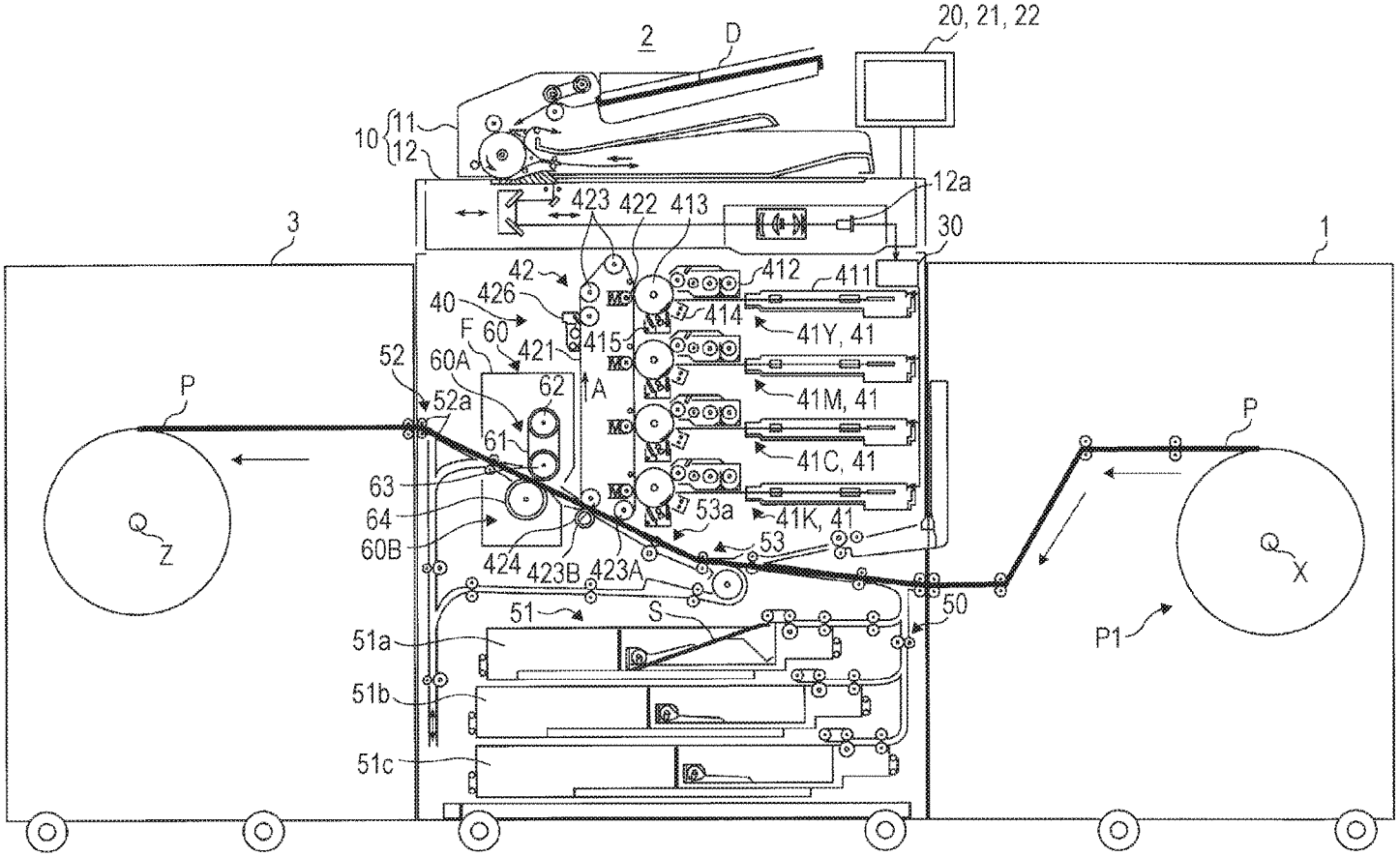
FIG. 1 is a diagram schematically showing the entire configuration of an image forming system according to an embodiment.
Figure 2:
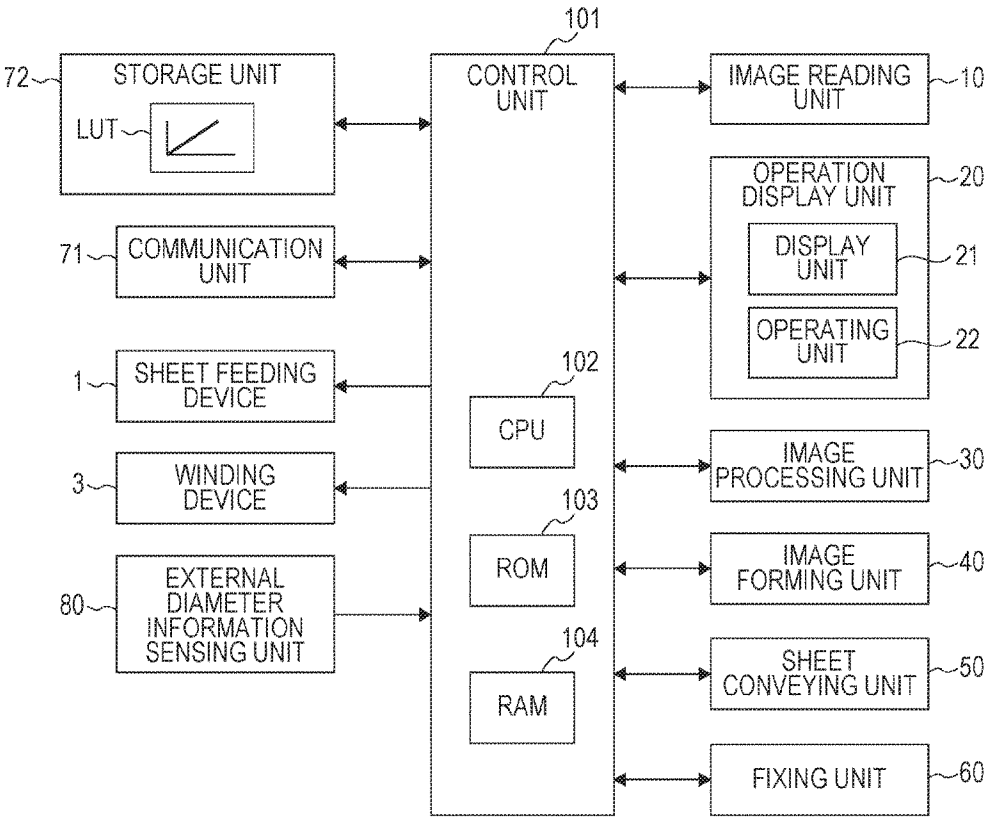
FIG. 2 is a diagram showing the principal components of the control system of an image forming apparatus according to the embodiment.

Hereinafter, an embodiment of the present invention will be described in detail with reference to the drawings. However, the scope of the invention is not limited to the illustrated examples. FIG. 1 is a diagram schematically showing the entire configuration of an image forming system 100 according to this embodiment. FIG. 2 shows the principal components of the control system of the image forming apparatus 2 in the image forming system 100 according to this embodiment. The image forming system 100 is a system that uses a long paper P sheet or paper sheets S (standard paper sheets) as a recording medium as indicated by the bold line in FIG. 1, and forms images on the long paper sheet P or the paper sheets S. Here, the long paper sheet P is a paper sheet that has a greater length than the width of the main unit of the image forming apparatus 2 in the direction of conveyance, for example. The long paper sheet P is equivalent to the "recording medium" of an embodiment of the invention.

As shown in FIG. 1, the image forming system 100 is formed by connecting a sheet feeding device 1, the image forming apparatus 2, and a winding device 3 in this order from the upstream side in the direction of conveyance of the long paper sheet P (this direction will be also referred to as the "sheet conveyance direction"). The sheet feeding device 1 and the winding device 3 are used in forming images on the long paper sheet P.

The sheet feeding device 1 is a device that supplies the long paper sheet P to the image forming apparatus 2. In the housing of the sheet feeding device 1, a roll unit P1 formed by winding the long paper sheet P into a roll around a support shaft X is rotatably held as shown in FIG. 1. The sheet feeding device 1 conveys the long paper sheet P wound around the support shaft X to the image forming apparatus 2 at a constant speed via pairs of conveyance rollers such as roll-out rollers and sheet feeding rollers. The sheet feeding operation of the sheet feeding device 1 is controlled by a control unit 101 of the image forming apparatus 2.

The image forming apparatus 2 is a color image forming apparatus of an intermediate transfer type using an electrophotographic process technology. Specifically, the image forming apparatus 2 performs a primary transfer of toner images in the respective colors of Y (yellow), M (magenta), C (cyan), and K (black) from photosensitive drums 413 onto an intermediate transfer belt 421, and overlaps the toner images in the four colors on one another on the intermediate transfer belt 421. After that, the image forming apparatus 2 performs a secondary transfer of the toner images onto the long paper sheet P supplied from the sheet feeding device 1 or a paper sheet S sent out from one of sheet feeder tray units 51*a* through 51*c*. Thus, an image is formed.

In the image forming apparatus 2, a tandem system is employed so that the photosensitive drums 413 corresponding to the four colors of YMCK are arranged in series in the conveyance direction of the intermediate transfer belt 421, and toner images in the respective colors are sequentially transferred onto the intermediate transfer belt 421 by one operation.

As shown in FIG. 2, the image forming apparatus 2 includes an image reading unit 10, an operation display unit 20, an image processing unit 30, an image forming unit 40, a sheet conveying unit 50, a fixing unit 60, an external diameter information sensing unit 80, and the control unit 101.

The control unit 101 includes a CPU (Central Processing Unit) 102, a ROM (Read Only Memory) 103, and a RAM (Random Access Memory) 104. The CPU 102 reads a program in accordance with the purpose of processing from the ROM 103, and loads the program into the RAM 104. In conjunction with the loaded program, the CPU 102 controls operation of each block and the like of the image forming apparatus 2 in a centralized manner. At this point of operation, various kinds of data stored in a storage unit 72 are referred to. The storage unit 72 is formed with a nonvolatile semiconductor memory (a so-called flash memory) or a hard disk drive, for example.

The control unit 101 performs transmission and reception of various kinds of data to and from an external device (a personal computer, for example) connected to a communication network such as a LAN (Local Area Network) or a WAN (Wide Area Network) via a communication unit 71. The control unit 101 receives image data transmitted from an external device, for example, and causes formation of an image on the long paper sheet P or the paper sheet S in accordance with the image data (input image data). The communication unit 71 is formed with a communication control card, such as a LAN card.

As shown in FIG. 1, the image reading unit 10 is designed to include an automatic document feeding device 11 called an ADF (Auto Document Feeder), and a document image scanning device 12 (a scanner).

The automatic document feeding device 11 conveys a document D placed on a document tray with a conveyance mechanism, to send the document D to the document image scanning device 12. By virtue of the automatic document feeding device 11, images of a large number of documents D placed on the document tray can be consecutively and collectively read.

The document image scanning device 12 optically scans a document conveyed onto a contact glass from the automatic document feeding device 11 or a document placed on the contact glass, and forms an image on the light receiving surface of a CCD (Charge Coupled Device) sensor 12*a* with light reflected from the document. In this manner, a document image is read. The image reading unit 10 generates input image data in accordance with the results of the reading performed by the document image scanning device 12. This input image data is subjected to predetermined image processing at the image processing unit 30.

As shown in FIG. 2, the operation display unit 20 is formed with a liquid crystal display (LCD) having a touch panel, for example, and functions as a display unit 21 and an operating unit 22. The display unit 21 displays various operation screens, conditions of images, operating conditions of respective functions, and the like, in accordance with display control signals that are input from the control unit 101. The operating unit 22 includes various kinds of operation keys such as a numeric keypad and a start key, to receive various input operations from users and output operating signals to the control unit 101.

The image processing unit 30 includes a circuit or the like that performs digital image processing on input image data in accordance with initial settings or user settings. For example, the image processing unit 30 performs tone correction based on tone correction data (a tone correction table) under the control of the control unit 101. The image processing unit 30 also performs various correction processes other than the tone correction, such as color correction and shading correction, a compression process, and the like, on the input image data. The image forming unit 40 is controlled in accordance with the image data subjected to those processes.

As shown in FIG. 1, the image forming unit 40 includes image formation units 41Y, 41M, 41C, and 41K, and an intermediate transfer unit 42. The image formation units 41Y, 41M, 41C, and 41K form images with the respective single-color toners of the Y component, the M component, the C component, and the K component, in accordance with the input image data.

The image formation units 41Y, 41M, 41C, and 41K for the Y component, the M component, the C component, and the K component each have the same structure. For ease of explanation and simplification of illustration in the drawings, like structural elements are denoted by like reference numerals, and Y, M, C, or K is attached to a reference numeral where there is a need for a distinction. In FIG. 1, only the structural elements of the image formation unit 41Y for the Y component are denoted by reference numerals, and the structural elements of the other image formation units 41M, 41C, and 41K are not.

Each image formation unit 41 includes an exposing device 411, a developing device 412, a photosensitive drum 413, a charging device 414, and a drum cleaning device 415.

The photosensitive drum 413 is an organic photoconductor (OPC) of a negative charge type that is formed by sequentially stacking an undercoat layer (UCL), a charge generation layer (CGL), and a charge transport layer (CTL) on a conductive cylinder that has a drum diameter of 80 mm and is made of aluminum (an aluminum tube), for example. The charge generation layer is formed with an organic semiconductor containing a charge generating material (phthalocyanine pigment, for example) dispersed in a resin binder (polycarbonate, for example), and generates a pair of a positive charge and a negative charge upon exposure performed by the exposing device 411. The charge transport layer is formed by dispersing a hole transporting material (an electron donating nitrogen-containing compound) in a resin binder (a polycarbonate resin, for example), and transports the positive charge generated in the charge generation layer to the surface of the charge transport layer.

The control unit 101 causes the photosensitive drum 413 to rotate at a constant circumferential velocity by controlling the drive current to be supplied to the drive motor (not shown) for causing the photosensitive drum 413 to rotate.

The charging device 414 uniformly and negatively charges the surface of the photosensitive drum 413 that has photoconductivity. The exposing device 411 is formed with a semiconductor laser, for example. The exposing device 411 illuminates the photosensitive drum 413 with laser light in accordance with the image of the corresponding color component. As the positive charge generated in the charge generation layer of the photosensitive drum 413 is transported to the surface of the charge transport layer, the surface charge (the negative charge) of the photosensitive drum 413 is neutralized. As a result, an electrostatic latent image of the corresponding color component is formed on the surface of the photosensitive drum 413 by virtue of a potential difference from the surrounding area.

The developing device 412 is a two-component developing device. The developing device 412 applies the toner of the corresponding color component onto the surface of the photosensitive drum 413, to make the electrostatic latent image visible and form a toner image.

The drum cleaning device 415 includes a drum cleaning blade or the like that is in contact with and slides on the surface of the photosensitive drum 413, and removes untransferred toner remaining on the surface of the photosensitive drum 413 after the primary transfer.

The intermediate transfer unit 42 includes the intermediate transfer belt 421, primary transfer rollers 422, supporting rollers 423, a secondary transfer roller 424, and a belt cleaning device 426. The secondary transfer roller 424 is equivalent to the transfer unit of an embodiment of the invention.

The intermediate transfer belt 421 is formed with an endless belt, and is stretched in the form of a loop by the supporting rollers 423. At least one of the supporting rollers 423 is a driving roller, and the other ones are following rollers. For example, a roller 423A that is located on the downstream side of the primary transfer roller 422 for the K component in the belt moving direction is preferably the driving roller. With this, the moving speed of the belt in the primary transfer unit can be easily maintained at a constant speed. As the driving roller 423A rotates, the intermediate transfer belt 421 moves in the direction indicated by an arrow A at a constant speed.

The intermediate transfer belt 421 is a belt that has conductivity and elasticity. The intermediate transfer belt 421 includes a high-resistance layer in its surface. The high-resistance layer has a volume resistivity of 8 to 11 log Ω·cm. The intermediate transfer belt 421 is rotatively driven by a control signal supplied from the control unit 101. The material, the thickness, and the hardness of the intermediate transfer belt 421 are not particularly limited, as long as the intermediate transfer belt 421 has conductivity and elasticity.

The primary transfer rollers 422 are placed on the inner circumferential surface side of the intermediate transfer belt 421, facing the photosensitive drums 413 of the respective color components. As the primary transfer rollers 422 are pressed against the photosensitive drums 413 with the intermediate transfer belt 421 interposed in between, primary transfer nips for transferring toner images from the photosensitive drums 413 onto the intermediate transfer belt 421 are formed.

The secondary transfer roller 424 is placed on the outer circumferential surface side of the intermediate transfer belt 421, facing a back-up roller 423B placed on the downstream side of the driving roller 423A in the belt moving direction. As the secondary transfer roller 424 is pressed against the back-up roller 423B with the intermediate transfer belt 421 interposed in between, a secondary transfer nip for transferring the toner image from the intermediate transfer belt 421 onto the long paper sheet P or the paper sheet S is formed.

When the intermediate transfer belt 421 passes through the primary transfer nips, the toner images on the photosensitive drums 413 are sequentially transferred onto the intermediate transfer belt 421 in an overlapping manner. Specifically, a primary transfer bias is applied to each primary transfer roller 422 to provide the back surface side of the intermediate transfer belt 421 (or the side in contact with the primary transfer rollers 422) with a charge of the opposite polarity from that of the toner. In this manner, the toner images are electrostatically transferred onto the intermediate transfer belt 421.

When the long paper sheet P or the paper sheet S passes through the secondary transfer nip, the toner image on the intermediate transfer belt 421 is transferred onto the long paper sheet P or the paper sheet S. Specifically, a secondary transfer bias is applied to the secondary transfer roller 424 to provide the back surface side of the long paper sheet P or the paper sheet S (or the side in contact with the secondary transfer roller 424) with a charge of the opposite polarity from that of the toner. In this manner, the toner image is electrostatically transferred onto the long paper sheet P or the paper sheet S. The long paper sheet P or the paper sheet S having the toner image transferred thereonto is then conveyed toward the fixing unit 60.

The belt cleaning device 426 removes the toner remaining on the surface of the intermediate transfer belt 421 after the secondary transfer. The secondary transfer roller 424 may be replaced with a belt-type secondary transfer unit having a secondary transfer belt that is stretched in the form of a loop by more than one supporting roller including a secondary transfer roller.

The fixing unit 60 includes: an upper fixing unit 60A that has a fixing-surface-side member placed on the fixing surface of the long paper sheet P or the paper sheet S (or the surface on which the toner image is formed); and a lower fixing unit 60B that has a back-surface-side supporting member placed on the back surface of the long paper sheet P or the paper sheet S (or the surface on the opposite side from the fixing surface). As the back-surface-side supporting member is pressed against the fixing-surface-side member, a fixing nip for nipping and conveying the long paper sheet P or the paper sheet S is formed.

At the fixing nip, the fixing unit 60 heats and presses the long paper sheet P or the paper sheet S that has the toner image transferred thereonto through the secondary transfer and has been conveyed. In this manner, the toner image is fixed onto the long paper sheet P or the paper sheet S. The fixing unit 60 is disposed as a unit in a fixing device F. An air separating unit that separates the long paper sheet P or the paper sheet S from the fixing-surface-side member or the back-surface-side supporting member by blowing air thereto may also be disposed in the fixing device F.

The upper fixing unit 60A includes an endless fixing belt 61 serving as the fixing-surface-side member, a heating roller 62, and a fixing roller 63 (a belt heating system). The fixing belt 61 is stretched by the heating roller 62 and the fixing roller 63 with a belt tension of 40 N, for example.

The fixing belt 61 is brought into contact with the long paper sheet P or the paper sheet S having the toner image formed thereon, and thermally fixes the toner image onto the long paper sheet P or the paper sheet S at a fixing temperature of 160 to 200° C., for example. Here, the fixing temperature is a temperature at which the amount of heat necessary for melting the toner on the long paper sheet P or the paper sheet S can be supplied. The fixing temperature varies depending on the paper type or the like of the long paper sheet P or the paper sheet S on which image formation is performed.

The heating roller 62 includes a heat source (a halogen heater), and heats the fixing belt 61. The temperature of the heat source is controlled by the control unit 101. The heating roller 62 is heated by the heat source. As a result, the fixing belt 61 is heated.

Driving of the fixing roller 63 (such as switching on and off of rotation, and the circumferential velocity of the fixing roller 63) is controlled by the control unit 101. The control unit 101 causes the fixing roller 63 to rotate in the clockwise direction. As the fixing roller 63 rotates, the fixing belt 61 and the heating roller 62 follow the rotation in the clockwise direction.

The lower fixing unit 60B includes a pressure roller 64 that serves as the back-surface-side supporting member (a roller pressing system). The pressure roller 64 is formed by stacking an elastic layer made of silicon rubber or the like, and a surface layer formed with a PFA tube on the outer peripheral surface of a cylindrical cored bar made of iron or the like. The pressure roller 64 is pressed against the fixing roller 63 via the fixing belt 61 by a pressing/separating unit (not shown) with a fixing load of 1000 N, for example. The pressing/separating unit has a known structure. The pressing/separating unit presses the fixing belt 61 and the pressure roller 64 against each other, or separates the fixing belt 61 and the pressure roller 64 from each other. As a result, the fixing nip for nipping and conveying the long paper sheet P or the paper sheet S is formed between the fixing belt 61 and the pressure roller 64. Driving of the pressure roller 64 (such as switching on and off of rotation, and the circumferential velocity of the pressure roller 64), and driving of the pressing/separating unit are controlled by the control unit 101. The control unit 101 causes the pressure roller 64 to rotate in the counterclockwise direction.

The sheet conveying unit 50 includes a sheet feeding unit 51, a sheet discharging unit 52, and a conveyance path unit 53. Paper sheets S (standard paper sheets or special paper sheets) sorted out in accordance with basis weights, sizes, and the like are stored on the basis of predetermined types in the three sheet feeder tray units 51*a* through 51*c* that constitute the sheet feeding unit 51. The conveyance path unit 53 includes pairs of conveyance rollers including a pair of resist rollers 53*a*. A resist roller unit in which the pair of resist rollers 53*a* are disposed corrects tilts or deviations of the paper sheets S or the long paper sheet P.

The paper sheets S stored in the sheet feeder tray units 51*a* through 51*c* are sent out one by one, starting from the uppermost one. The paper sheets S are conveyed to the image forming unit 40 by the conveyance path unit 53. In the image forming unit 40, the toner images on the intermediate transfer belt 421 are collectively transferred onto one of the surfaces of the paper sheet S through secondary transfer, and a fixing step is carried out in the fixing unit 60. Alternatively, the long paper sheet P supplied from the sheet feeding device 1 into the image forming apparatus 2 is conveyed to the image forming unit 40 by the conveyance path unit 53. In the image forming unit 40, the toner images on the intermediate transfer belt 421 are collectively transferred onto one of the surfaces of the long paper sheet P through secondary transfer, and a fixing step is carried out in the fixing unit 60. The long paper sheet P or the paper sheet S on which image formation has been performed is conveyed to the winding device 3 by the sheet discharging unit 52 including a pair of conveyance rollers (a pair of sheet discharge rollers) 52*a*.

The winding device 3 is the device that winds up the long paper sheet P conveyed from the image forming apparatus 2. In the housing of the winding device 3, the long paper sheet P is wound around a support shaft Z, and is held in the form of a roll. The winding device 3 winds the long paper sheet P conveyed from the image forming apparatus 2 around the support shaft Z at a constant speed via pairs of conveyance rollers (such as roll-out rollers and sheet discharge rollers). The winding operation of the winding device 3 is controlled by a control unit 101 of the image forming apparatus 2.

Figure 3A:
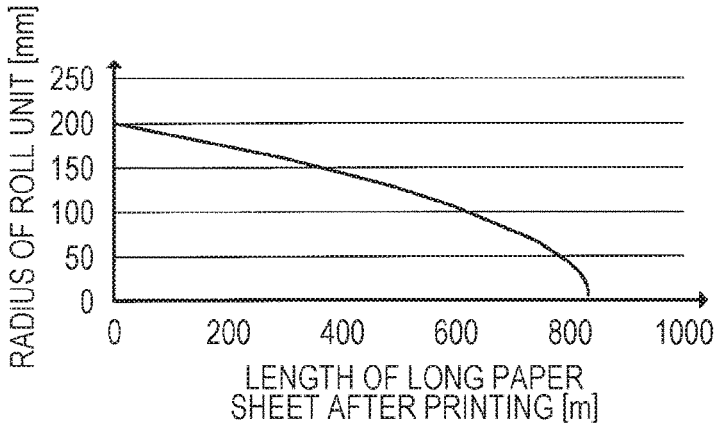
FIG. 3A is a graph showing an example of a relationship between the radius of a roll unit and the length of a long paper sheet subjected to printing.

As shown in FIG. 2, the external diameter information sensing unit 80 is a displacement sensor. The external diameter information sensing unit 80 is designed to sense information about the external diameter of the roll unit P1 in the sheet feeding device 1 by measuring the distance from the upper end to the lower end of the roll unit P1, for example. As shown in FIG. 3A, the radius of the roll unit P1 becomes smaller as the printing operation progresses. In view of this, the information about the external diameter can be sensed by the external diameter information sensing unit 80 in this embodiment.

The external diameter information sensing unit 80 may be designed to receive a user input of the external diameter of the roll unit P1 in the initial state, and predict the information about the external diameter of the roll unit P1 from the number of rotations and the rotation time of the support shaft X. Alternatively, the external diameter information sensing unit 80 may be designed to sense the weight of the entire roll unit P1, and predict the information about the external diameter of the roll unit P1 from a change in the weight of the roll unit P1.

Figure 3B:
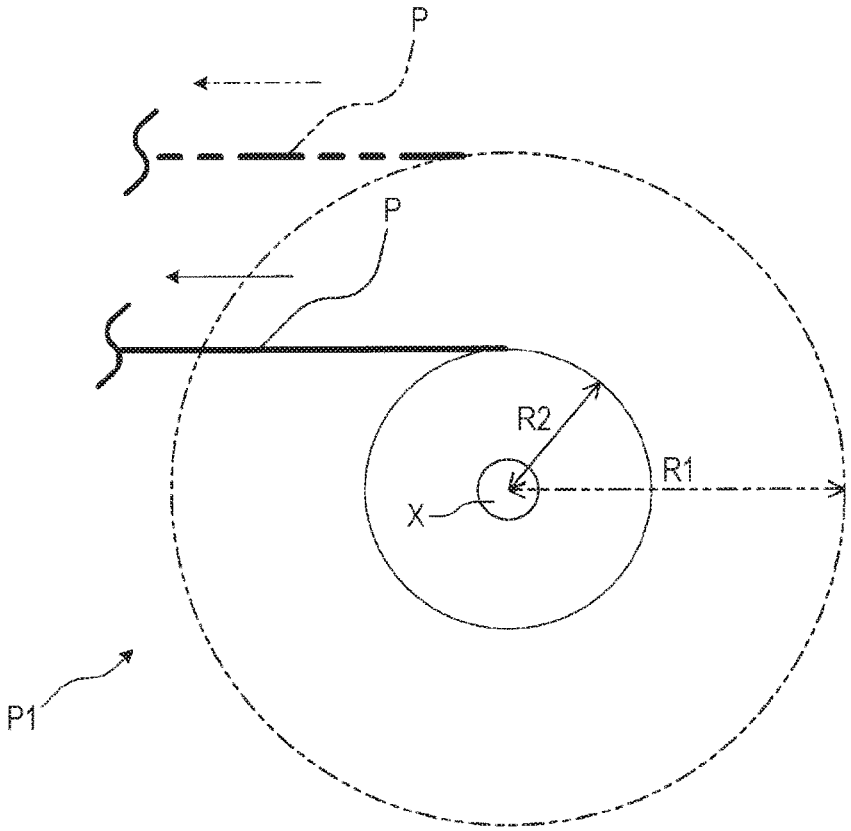
FIG. 3B is an enlarged view of the roll unit in a sheet feeding device.

The long paper sheet P is wound around the support shaft X, as shown in FIGS. 1 and 3B. When conveyed into the image forming apparatus 2, the long paper sheet P is curled in a convex fashion on the opposite side from the support shaft X. More specifically, when printing is performed on the front surface of the long paper sheet P or the surface facing the opposite side from the support shaft X, the long paper sheet P is curled in a convex fashion on the side of the intermediate transfer belt 421.

As the long paper sheet P is conveyed toward the inner side in the radial direction of the roll unit P1, the curvature radius becomes smaller. In view of this, the degree of curling becomes higher as the printing operation progresses. That is, the degree of curling of the long paper sheet P at the location where the radius of the roll unit P1 is R2, which is smaller than R1, is higher than the degree of curling at a location where the radius of the roll unit P1 is R1.

Figure 4A:
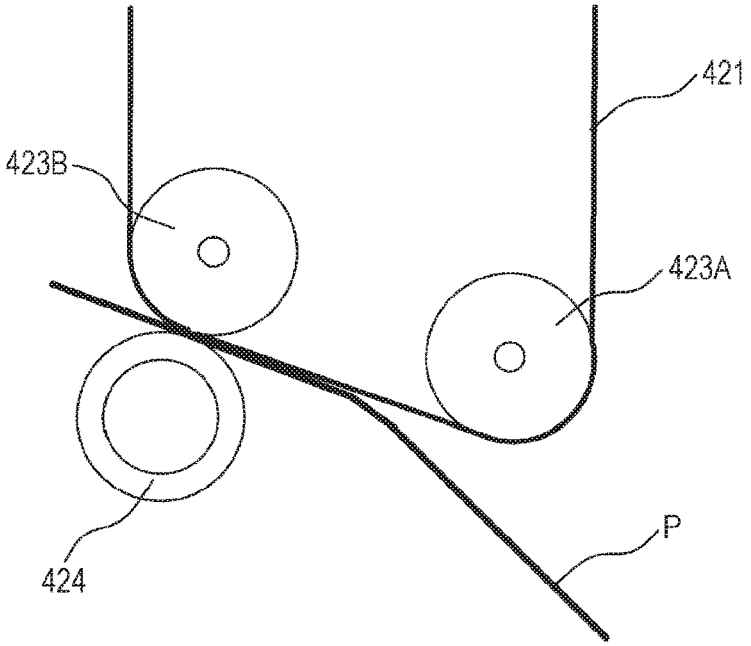
FIG. 4A is a diagram showing a situation where the long paper sheet with a high degree of curling is passing by an intermediate transfer belt.
Figure 4B:
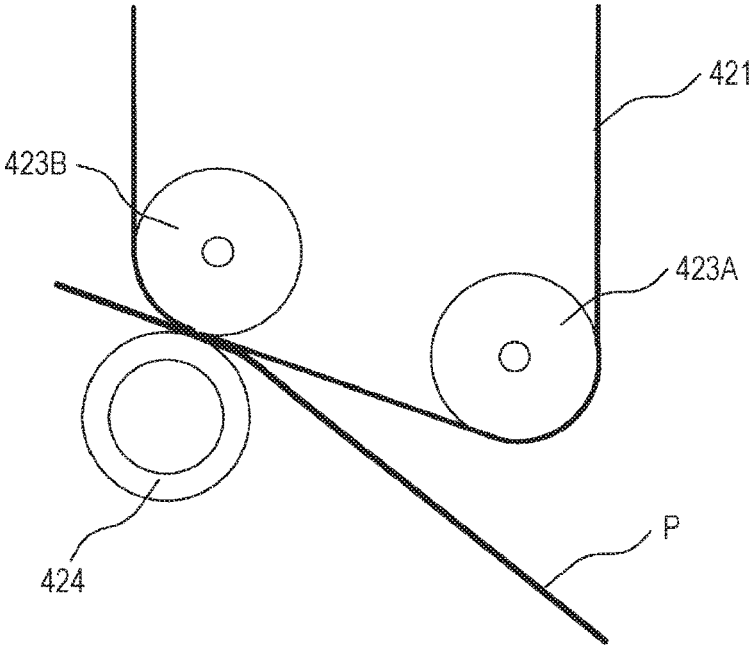
FIG. 4B is a diagram showing a situation where the long paper sheet with a low degree of curling is passing by the intermediate transfer belt.

As shown in FIGS. 4A and 4B, the long paper sheet P enters the transfer position on the intermediate transfer belt 421 through a path that becomes gradually closer to the intermediate transfer belt 421 as it approaches the transfer position. As shown in FIG. 4A, when printing is performed on the front surface of the long paper sheet P, the long paper sheet P is curled in a convex fashion on the side of the intermediate transfer belt 421. Therefore, the long paper sheet P enters the transfer position through a path that becomes closer to the intermediate transfer belt 421 as the degree of curling becomes higher.

When the degree of curling of the long paper sheet P is low, on the other hand, the long paper sheet P enters the transfer position through a path that is further away from the intermediate transfer belt 421 than in a case where the degree of curling is high. That is, the distance between the long paper sheet P and the intermediate transfer belt 421 becomes longer as the degree of curling becomes lower.

In regard to the long paper sheet P, the size of the roll unit P1 to be used normally varies among users. However, the diameter of the support shaft X that can be mounted in the sheet feeding device 1 is fixed. Therefore, the secondary transfer bias to be applied to the secondary transfer roller 424 is set at an appropriate value in a case where the radius of the roll unit P1 is small or where the degree of curling is high. The secondary transfer bias set at this appropriate value is greater than that in a case where the degree of curling is low.

In view of this, if a secondary transfer bias of a value higher than necessary when the degree of curling is low is applied, electrical discharge or noise easily occurs in a space between the intermediate transfer belt 421 and the long paper sheet P near the transfer position. If electrical discharge or noise occurs in this space, the polarity of the charge of the toner particles forming the toner image on the intermediate transfer belt 421 is reversed. As a result, a defective transfer occurs. Even if the secondary transfer bias is applied in the transfer position, the transfer image is not transferred to part of the long paper sheet P.

Figure 5A:
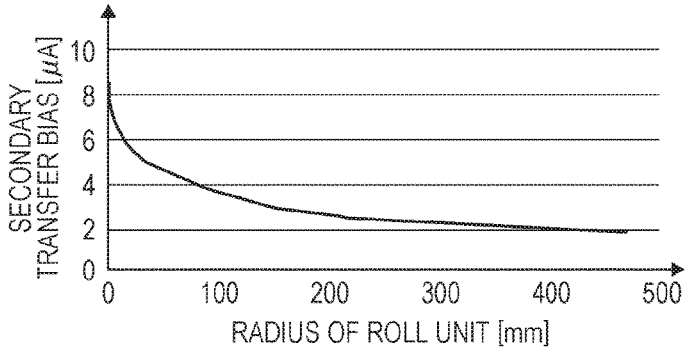
FIG. 5A is a graph showing an example of a relationship between the radius of the roll unit and a secondary transfer bias.

To counter this problem, the control unit 101 of this embodiment obtains the external diameter of the roll unit P1 from the external diameter information sensing unit 80, and performs control to change the transfer condition in accordance with the external diameter. Specifically, as shown in FIG. 5A, the control unit 101 performs control so that the value of the secondary transfer bias becomes greater as the external diameter or the radius of the roll unit P1 becomes smaller. With this, the secondary transfer bias can be always maintained at an appropriate value for the degree of curling of the long paper sheet P. Thus, a defective transfer due to curling of the long paper sheet P can be prevented.

Figure 5B:
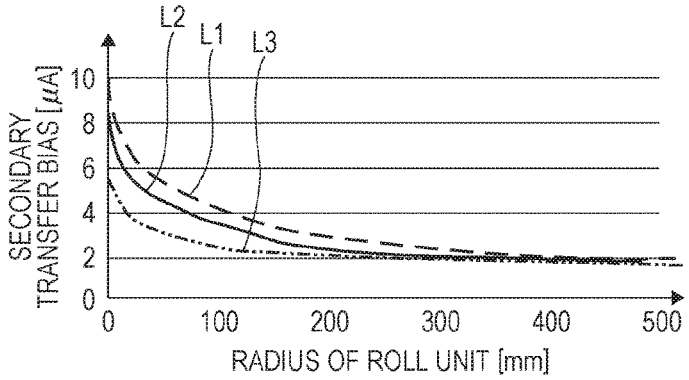
FIG. 5B is a graph showing an example of a relationship between the radius of the roll unit and the secondary transfer bias in a case where the basis weight is made to vary.

The control unit 101 performs control to change the transfer condition in accordance with the thickness of the long paper sheet P. FIG. 5B is a graph showing the relationships between the radius of the roll unit P1 and the secondary transfer bias while the basis weight is made to vary. A dashed line L1 shown in FIG. 5B indicates the relationship in a case where the basis weight is the largest among comparative examples. A solid line L2 indicates the relationship in a case where the basis weight is the second largest among the comparative examples. A dashed double-dotted line L3 indicates the relationship in a case where the basis weight is the smallest among the comparative examples.

As shown in FIG. 5B, the degree of curling of the long paper sheet P indicated by the dashed line L1 is high, since the basis weight in the case of the dashed line L1 is larger than that in the case of the solid line L2. In view of this, at a time of printing on paper in the case of the dashed line L1, the control unit 101 sets the secondary transfer bias at a greater value than that at a time of printing on paper in the case of the solid line L2. The basis weight indicated by the dashed double-dotted line L3 is smaller than that in the case of the solid line L2. Therefore, at a time of printing on paper in the case of the dashed double-dotted line L3, the control unit 101 sets the secondary transfer bias at a smaller value than that at a time of printing on paper in the case of the solid line L2.

Figure 5C:
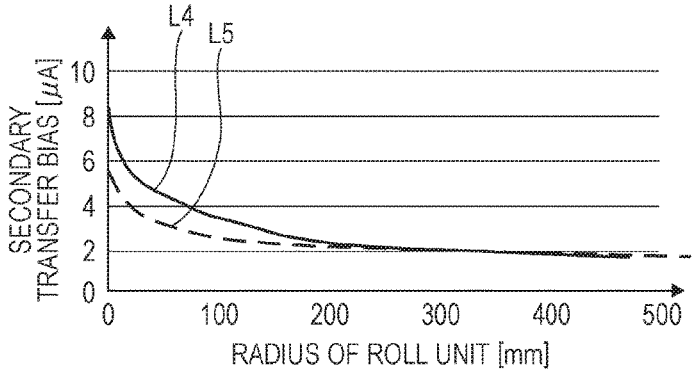
FIG. 5C is a graph showing an example of a relationship between the radius of the roll unit and the secondary transfer bias in a case where the paper type is made to vary.

The control unit 101 performs control to change the transfer condition in accordance with the paper type of the long paper sheet P. FIG. 5C is a graph showing the relationships between the radius of the roll unit P1 and the secondary transfer bias while the paper type is made to vary. A solid line L4 shown in FIG. 5C indicates a paper sheet made of polyethylene terephthalate, which is the hardest material among the comparative examples. A dashed line L5 indicates a standard paper sheet made of the softest material among the comparative examples.

As shown in FIG. 5C, the degree of curling of the long paper sheet P indicated by the dashed line L5 is low, since the material used in the case of the dashed line L5 is softer than that used in the case of the solid line L4. In view of this, at a time of printing on paper in the case of the dashed line L5, the control unit 101 sets the secondary transfer bias at a smaller value than that at a time of printing on paper in the case of the solid line L4.

Figure 6A:
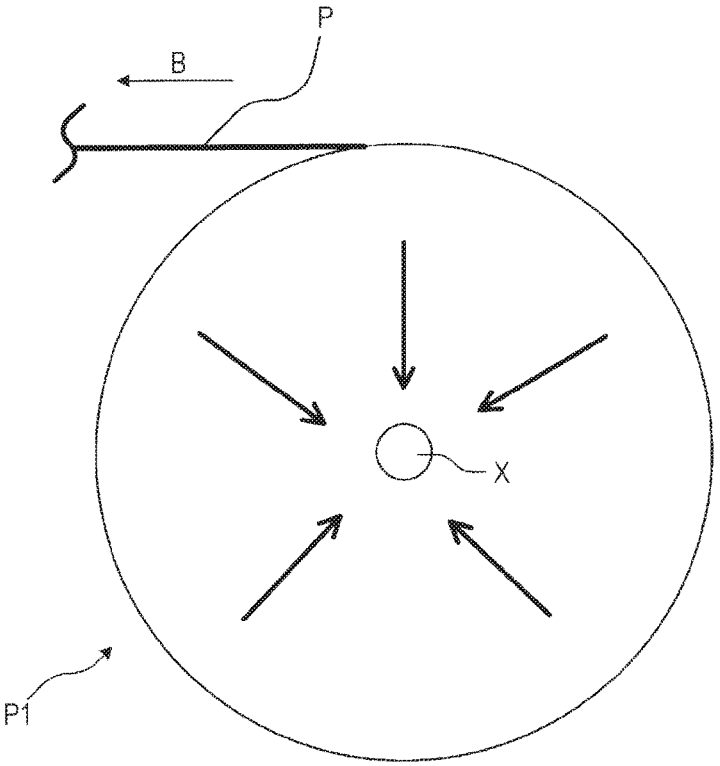
FIG. 6A is a diagram showing the roll unit being wound up while a tension is being applied thereto.

As shown in FIG. 6A, to prevent misalignment in winding at the time of processing, the roll unit P1 is formed by winding up the long paper sheet P while a tension is applied to the long paper sheet P in the direction indicated by an arrow B. In this manner, a force toward the center is generated in the roll unit P1. As a result, the degree of curling becomes higher in the direction toward the center of the roll unit P1. The misalignment in winding varies depending on characteristics of the long paper sheet P, such as friction between paper surfaces. Therefore, the tension to be applied is made to vary in some cases. The tension to be applied to the roll unit P1 at the time of processing is set at a value of 30 to 100 N.

Figure 6B:
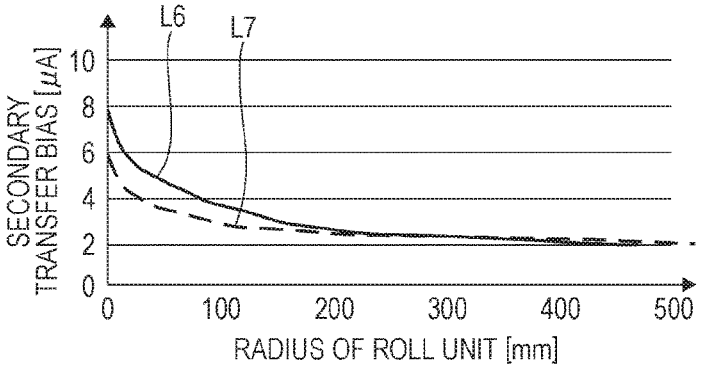
FIG. 6B is a graph showing an example of a relationship between the radius of the roll unit and the secondary transfer bias in a case where the tension is made to vary.

In view of the above, the control unit 101 performs control to change the transfer condition in accordance with the tension of the long paper sheet P at the time of winding of the long paper sheet P in this embodiment. FIG. 6B is a graph showing the relationships between the radius of the roll unit P1 and the secondary transfer bias while the tension is made to vary. A solid line L6 shown in FIG. 6B indicates a case where the tension of the roll unit P1 is set at 80 N, and a dashed line L7 indicates a case where the tension of the roll unit P1 is set at 40 N.

As shown in FIG. 6B, the degree of curling of the long paper sheet P indicated by the solid line L6 is high, since the tension in the case of the solid line L6 is higher than that in the case of the dashed line L7. In view of this, at a time of printing on paper in the case of the solid line L6, the control unit 101 sets the secondary transfer bias at a greater value than that at a time of printing on paper in the case of the dashed line L7.

If the user inputs the tension setting value at the time of processing directly to the apparatus, the transfer condition can be more appropriately corrected in accordance with the degree of curling. In a case where information about the processing of the roll unit P1 is not clear, the tension may have a value measured by a Schmidt hammer. In that case, the value measured by a method specified in JIS A 1155 (2003) (ISO 1920-7 2004) is preferably a value between 15 and 40.

Adhesive paper, particularly the long paper sheet P to be used for frozen foods, has a three-layer structure that has an adhesive portion interposed between a paper portion and a peeling portion. Since the adhesive layer is soft and thick so that the adhesive will not solidify at low temperature. Therefore, the adhesive might leak from the roll unit P1 due to the tension at the time of processing. As the adhesive leaks out, the roll unit P1 loosens, and the degree of curling becomes lower than usual. Furthermore, the adhesive becomes softer at high temperature. Therefore, when stored at high temperature for a long period of time, the adhesive easily leaks out.

Figure 7A:
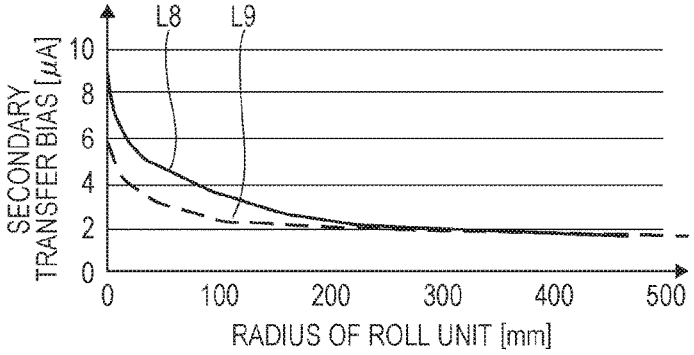
FIG. 7A is a graph showing an example of a relationship between the radius of the roll unit and the secondary transfer bias in a case where the storage history is made to vary.

In view of the above, the control unit 101 performs control to change the transfer condition in accordance with the history of storage of the long paper sheet P in this embodiment. FIG. 7A is a graph showing the relationships between the radius of the roll unit P1 and the secondary transfer bias while the storage history is made to vary. A solid line L8 shown in FIG. 7A indicates a case where the storage history is the shortest among the comparative examples, and a dashed line L9 indicates a case where the storage history is the longest among the comparative examples.

As shown in FIG. 7A, the storage history indicated by the dashed line L9 is longer than that in the case indicated by the solid line L8. Since the tension being applied to the roll unit P1 becomes lower with time, the degree of curling of the long paper sheet P becomes lower. In view of this, at a time of printing on paper in the case of the dashed line L9, the control unit 101 sets the secondary transfer bias at a smaller value than that at a time of printing on paper in the case of the solid line L8. If the user inputs a storage history directly to the apparatus, the transfer condition can be more appropriately corrected.

Figure 7B:
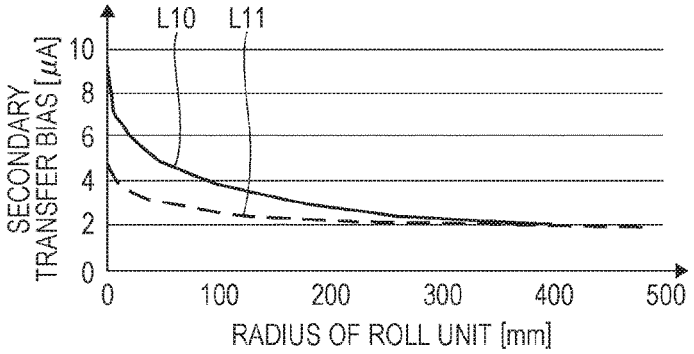
FIG. 7B is a graph showing an example of a relationship between the radius of the roll unit and the secondary transfer bias in a case where the humidity in the area surrounding the image forming apparatus is made to vary.

The level of the occurrence of electrical discharge at the transfer position varies with the humidity condition in the area surrounding the image forming apparatus 2. Particularly, as the absolute humidity becomes lower, the surface on the opposite side from the support shaft X becomes smaller. As a result, the tension of the roll unit P1 becomes higher, and the degree of curling of the roll unit P1 tends to become higher. In view of the above, the control unit 101 performs control to change the transfer condition in accordance with the humidity condition in this embodiment. FIG. 7B is a graph showing the relationships between the radius of the roll unit P1 and the secondary transfer bias while the humidity condition is made to vary. A solid line L10 shown in FIG. 7B indicates a case where the absolute humidity is the lowest among the comparative examples, and a dashed line L11 indicates a case where the absolute humidity is the highest among the comparative examples.

As shown in FIG. 7B, the degree of curling of the long paper sheet P indicated by the solid line L10 is high, since the absolute humidity in the case of the solid line L10 is lower than that in the case of the dashed line L11. In view of this, at a time of printing on paper in the case of the solid line L10, the control unit 101 sets the secondary transfer bias at a greater value than that at a time of printing on paper in the case of the dashed line L11.

The level of the occurrence of electrical discharge at the transfer position varies with the temperature condition in the area surrounding the image forming apparatus 2. Particularly, as the temperature becomes lower, the long paper sheet P becomes smaller, and accordingly, the tension of the roll unit P1 becomes higher. In view of the above, the control unit 101 performs control to change the transfer condition in accordance with the temperature condition in this embodiment. Specifically, as the temperature becomes lower, the degree of curling of the long paper sheet P becomes higher. Therefore, when the temperature is low, the control unit 101 sets the secondary transfer bias at a greater value than that at a high temperature.

Figure 7C:
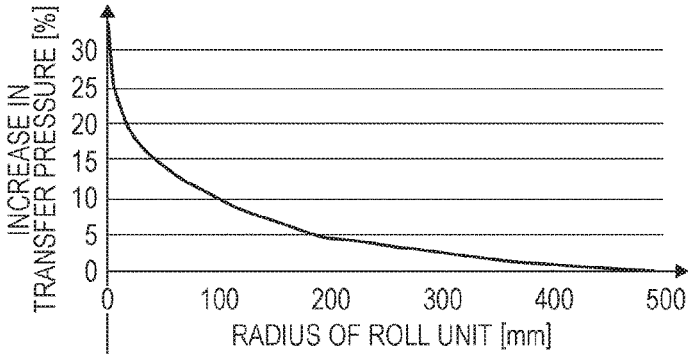
FIG. 7C is a graph showing an example of a relationship between the radius of the roll unit and increases in transfer pressure.

In the above described examples, the control unit 101 regards the secondary transfer bias as the transfer condition. However, the transfer condition is not limited to that. For example, the transfer condition may be the transfer pressure applied onto the back-up roller 423B by the secondary transfer roller 424, or the force of the secondary transfer roller 424 pressing the back-up roller 423B that faces the secondary transfer roller 424. FIG. 7C is a graph showing an example of a relationship between the radius of the roll unit P1 and increase in the transfer pressure. The back-up roller 423B is equivalent to the "opposed member" of an embodiment of the present invention.

As shown in FIG. 7C, the control unit 101 performs controls so that the increase in the transfer pressure becomes larger as the radius of the roll unit P1 becomes smaller. The transfer pressure can be changed by adjusting the pressing force to be applied to the intermediate transfer belt 421 by the secondary transfer roller 424.

Under such conditions, the transfer pressure can be always maintained at an appropriate value for the degree of curling of the long paper sheet P. Thus, a defective transfer due to curling of the long paper sheet P can be prevented.

The control unit 101 can also perform any combination of the above described control operations. Thus, a defective transfer due to curling of the long paper sheet P can be prevented.

Figure 8A:
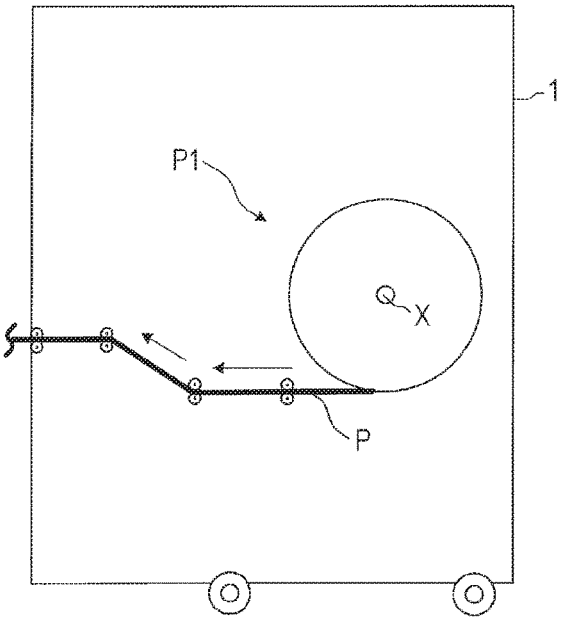
FIG. 8A is a diagram schematically showing the sheet feeding device in which the long paper sheet is set for back surface printing.

Meanwhile, when printing is performed on the back surface of the long paper sheet P or the surface on the side of the support shaft X, the roll unit P1 is disposed in the sheet feeding device 1 in such a manner that the long paper sheet P is send out from below the support shaft X, as shown in FIG. 8A, which shows vertically the opposite case of that shown in FIG. 1. The long paper sheet P passes through a path located under the roll unit P1, and is supplied to the image forming apparatus 2. In this case, the long paper sheet P is curled in a convex fashion on the opposite side from the intermediate transfer belt 421. This is the opposite of the corresponding aspect in the front surface printing.

Figure 8B:
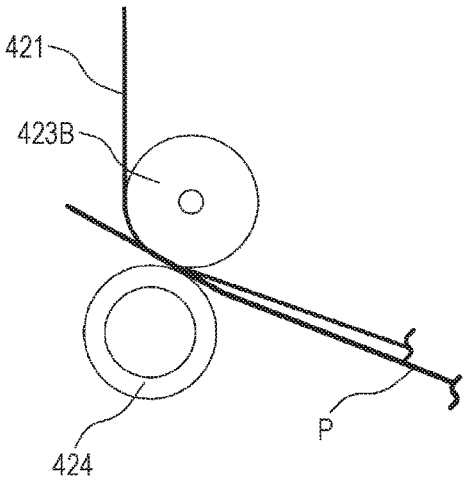
FIG. 8B is a diagram showing a situation where the long paper sheet with a low degree of curling is passing by an intermediate transfer belt.

Therefore, the long paper sheet P enters the transfer position through a path that becomes closer to the intermediate transfer belt 421 as the degree of curling becomes lower, as shown in FIG. 8B. In view of this, the control unit 101 needs to set the secondary transfer bias at a large value when the degree of curling is low.

Figure 8C:
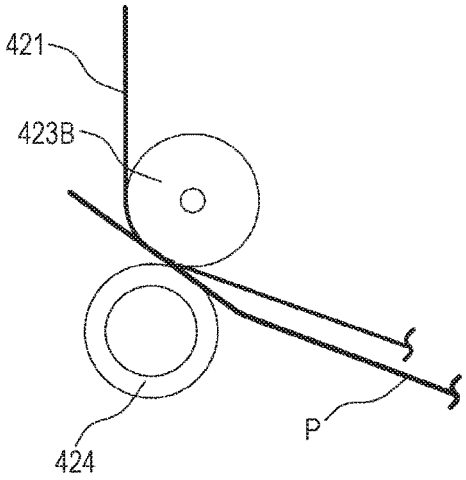
FIG. 8C is a diagram showing a situation where the long paper sheet with a high degree of curling is passing by the intermediate transfer belt.

On the other hand, the long paper sheet P enters the transfer position through a path that becomes further away from the intermediate transfer belt 421 as the degree of curling becomes higher, as shown in FIG. 8C. Therefore, if the secondary transfer bias is set at the same value as that in a case where the degree of curling is low, electrical discharge or noise easily occurs in the space between the intermediate transfer belt 421 and the long paper sheet P near the transfer position. As a result, a defective transfer occurs, as the toner image is not transferred onto part of the long paper sheet P.

In view of this, when printing is performed on the back surface of the long paper sheet P, the control unit 101 performs control so that the value of the secondary transfer bias becomes smaller as the external diameter of the roll unit P1 becomes smaller. Thus, the secondary transfer bias can be always set at an appropriate value for the degree of curling of the long paper sheet P.

Next, an example of a printing operation to be performed by the image forming apparatus 2 is described.

Figure 9:
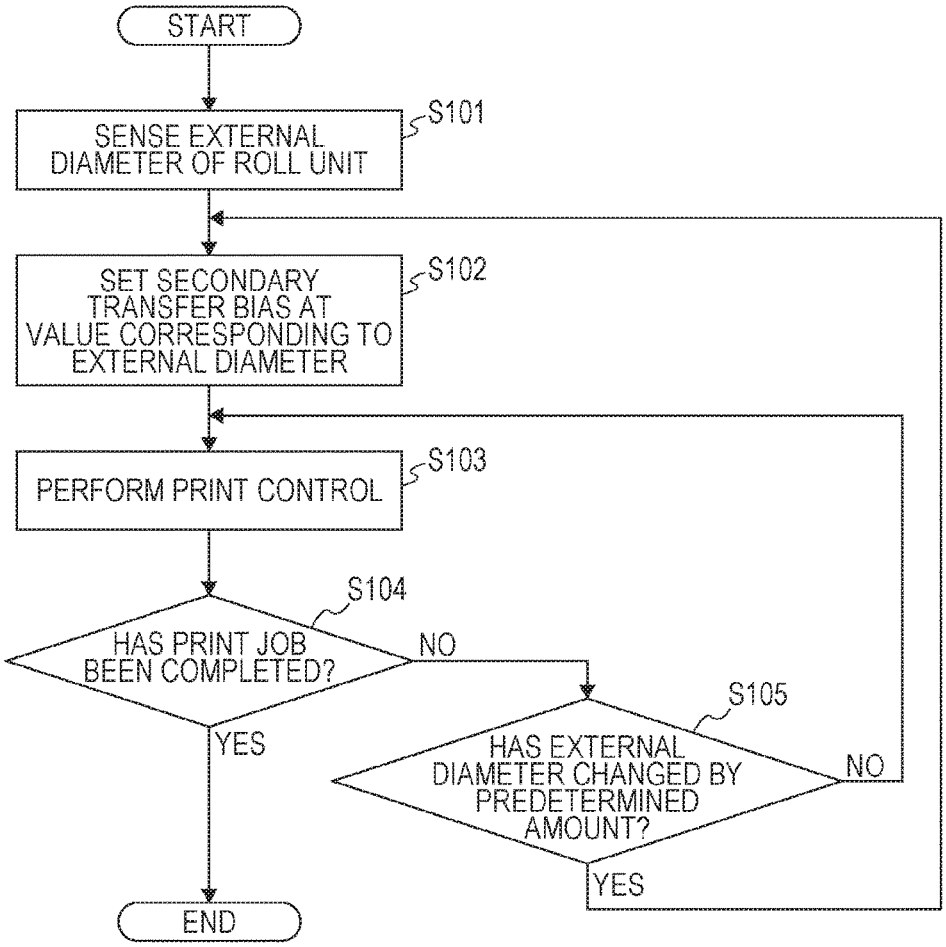
FIG. 9 is a flowchart showing an example of a printing operation to be performed by the image forming apparatus according to the embodiment.

FIG. 9 is a flowchart showing an example of a printing operation to be performed by the image forming apparatus 2 according to this embodiment. The process shown in FIG. 9 is performed when the control unit 101 receives an instruction to execute a print job. While the respective conditions such as the paper thickness are the same as those set at the start of a print job, the control unit 101 performs the control described below.

When a print job is started, the control unit 101 first senses the external diameter of the roll unit P1 (step S101). The control unit 101 then sets the transfer condition, or the secondary transfer bias, at the value corresponding to the external diameter (step S102). The control unit 101 then performs print control under the set conditions (step S103).

The control unit 101 next determines whether the print job has been completed (step S104). If the result of the determination indicates that the print job has been completed (YES in step S104), the image forming apparatus 2 ends the process shown in FIG. 9. If the print job has not been completed yet (NO in step S104), on the other hand, the control unit 101 determines whether the external diameter of the roll unit P1 has changed by a predetermined amount (3 mm, for example) (step S105).

If the result of the determination indicates that the external diameter of the roll unit P1 has changed by the predetermined amount (YES in step S105), the process returns to step S102. If the external diameter of the roll unit P1 has not changed by the predetermined amount (NO in step S105), the process returns to step S103.

As described above in detail, the image forming system 100 according to this embodiment includes: the secondary transfer roller 424 that transfers a toner image onto the long paper sheet P wound into a roll; and the control unit 101 that obtains the information about the external diameter of the wound long paper sheet P, and changes the condition for the transfer by the secondary transfer roller 424 in accordance with the information about the external diameter.

In this embodiment designed as above, the transfer condition can be always maintained at an appropriate value for the degree of curling of the long paper sheet P. Thus, a defective transfer due to curling of the long paper sheet P can be prevented.

The transfer condition can also be set at an appropriate value in accordance with conditions such as basis weight, paper type, tension, storage history, temperature, and humidity. Thus, a defective transfer can be prevented.

In the above described embodiment, the control unit 101 continuously changes the transfer condition in accordance with the radius of the roll unit P1. However, embodiments of the present invention are not limited to that, and a transfer condition that can be changed stepwise to predetermine several values may be changed stepwise in accordance with the radius of the roll unit P1, for example.

The above described embodiment is merely a specific example of the present invention, and the technical scope of the invention should not be construed in a restrictive manner in accordance with the embodiment. That is, the present invention can be embodied in various forms, without departing from its scope or principal features.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming system comprising:

an image forming apparatus comprising:

a transfer unit configured to transfer a toner image onto a recording medium conveyed from a state in which the recording medium is wound into a roll;

an external diameter information sensing unit configured to sense information about an external diameter of the recording medium wound into the roll; and a control unit configured to change a transfer condition in the transfer unit in accordance with the external diameter information sensed by the external diameter information sensing unit and a storage history of the recording medium;

a sheet feeding device structured to supply a continuous sheet to the image forming apparatus; and a sheet discharging unit structured to discharge a sheet, from the image forming apparatus, on which an image has been formed.

2. The image forming system according to claim 1, wherein the control unit performs control to change the transfer condition in accordance with the external diameter information and a type of the recording medium.

3. The image forming system according to claim 1, wherein the control unit performs control to change the transfer condition in accordance with the external diameter information and a basis weight of the recording medium.

4. The image forming system according to claim 1, wherein the control unit performs control to change the transfer condition in accordance with the external diameter information and at least one of a temperature and a humidity in an area surrounding the image forming system.

5. The image forming system according to claim 1, wherein the control unit performs control to change the transfer condition in accordance with the external diameter information and depending on which one of a front surface and a back surface of the recording medium the toner image is to be formed on.

6. The image forming system according to claim 1, wherein the transfer condition is a transfer bias to be applied to the transfer unit.

7. The image forming system according to claim 1, wherein the transfer condition is a force to press the transfer unit against an opposed member, the opposed member facing the transfer unit.

8. The image forming system according to claim 6, wherein, when the toner image is to be formed on a front surface of the recording medium, the control unit performs control to increase the transfer bias as the external diameter becomes smaller.

9. The image forming system according to claim 1, wherein the control unit reduces a transfer bias applied to the transfer unit as the storage history gets longer in a state where the recording medium is wound.

10. An image forming system comprising:

an image forming apparatus comprising:

a transfer unit configured to transfer a toner image onto a recording medium conveyed from a state in which the recording medium is wound into a roll;

an external diameter information sensing unit configured to sense information about an external diameter of the recording medium wound into the roll; and a control unit configured to change a transfer condition in the transfer unit in accordance with the external diameter information sensed by the external diameter information sensing unit and a tension applied when the recording medium is wound into the roll;

a sheet feeding device structured to supply a continuous sheet to the image forming apparatus; and a sheet discharging unit structured to discharge a sheet, from the image forming apparatus, on which an image has been formed.

11. An image forming system comprising:

an image forming apparatus comprising:

a transfer unit configured to transfer a toner image onto a recording medium conveyed from a state in which the recording medium is wound into a roll;

an external diameter information sensing unit configured to sense information about an external diameter of the recording medium wound into the roll; and a control unit configured to change a transfer condition in the transfer unit in accordance with the external diameter information sensed by the external diameter information sensing unit;

a sheet feeding device structured to supply a continuous sheet to the image forming apparatus; and a sheet discharging unit structured to discharge a sheet, from the image forming apparatus, on which an image has been formed, wherein the transfer condition is a transfer bias to be applied to the transfer unit, and wherein, when the toner image is to be formed on a back surface of the recording medium, the control unit performs control to reduce the transfer bias as the external diameter becomes smaller.

12. An image forming apparatus comprising:

a transfer unit configured to transfer a toner image onto a recording medium conveyed from a state in which the recording medium is wound into a roll;

an external diameter information sensing unit configured to sense information about an external diameter of the recording medium wound into the roll; and a control unit configured to change a transfer condition in the transfer unit in accordance with the external diameter information sensed by the external diameter information sensing unit and a storage history of the recording medium.

13. The image forming apparatus according to claim 12, wherein the control unit reduces a transfer bias applied to the transfer unit as the storage history gets longer in a state where the recording medium is wound.

14. A method of changing a transfer condition for transferring a toner image onto a recording medium conveyed from a state in which the recording medium is wound into a roll, the method comprising:

sensing information about an external diameter of the recording medium wound into the roll; and changing the transfer condition in accordance with the sensed external diameter information and a storage history of the recording medium.

15. The method of changing the transfer condition according to claim 14, further comprising:

reducing a transfer bias applied to a transfer unit as the storage history gets longer in a state where the recording medium is wound.

* * * * *